US006168336B1

(12) United States Patent
Thost et al.

(10) Patent No.: US 6,168,336 B1
(45) Date of Patent: Jan. 2, 2001

(54) BALLPOINT PEN FOR INK

(75) Inventors: Horst Thost, Buckenhof; Horst Kolb, Kalchreuth, both of (DE)

(73) Assignee: J. S. Staedtler GmbH & Co., Nürnberg (DE)

( * ) Notice: Under 35 U.S.C. 154(b), the term of this patent shall be extended for 0 days.

(21) Appl. No.: 09/237,744

(22) Filed: Jan. 26, 1999

(30) Foreign Application Priority Data

Jan. 31, 1998 (DE) ..... 198 03 622

(51) Int. Cl.[7] ..... B43K 7/10; B43K 7/08

(52) U.S. Cl. ..... 401/198; 401/205; 401/209; 401/216

(58) Field of Search ..... 401/199, 198, 401/205, 209, 212, 258, 216

(56) References Cited

U.S. PATENT DOCUMENTS

| | | | | |
|---|---|---|---|---|
| 4,145,148 | * | 3/1979 | Fukuoka | 401/199 X |
| 4,457,644 | * | 7/1984 | Yokosuka | 401/199 X |
| 4,671,692 | * | 6/1987 | Inaba | 401/199 |
| 4,973,180 | * | 11/1990 | Hori | 401/198 X |
| 5,352,051 | * | 10/1994 | Tamura et al. | 401/258 X |
| 5,904,432 | * | 5/1999 | Ando et al. | 401/209 |

FOREIGN PATENT DOCUMENTS

| | | | | |
|---|---|---|---|---|
| 806413 | | 6/1951 | (DE) . | |
| 1683079 | | 4/1954 | (DE) . | |
| 1748517 | | 8/1954 | (DE) . | |
| 2307620 | | 8/1974 | (DE) . | |
| 2701694 | | 4/1978 | (DE) . | |
| 2927046 | | 1/1980 | (DE) . | |
| 3000214 | | 7/1981 | (DE) . | |
| 31 31 538 A1 | | 2/1983 | (DE) . | |
| 4434164 | | 3/1996 | (DE) . | |
| 196 14 784 C1 | | 12/1997 | (DE) . | |
| 1024601 | | 5/1953 | (FR) . | |
| 26344 | * | 10/1970 | (JP) | 401/199 |

* cited by examiner

*Primary Examiner*—Henry J. Recla
*Assistant Examiner*—Kathleen J. Prunner
(74) *Attorney, Agent, or Firm*—Friedrich Kueffner

(57) ABSTRACT

A ballpoint pen in which ink is freely received in the shaft of the ballpoint pen or is received in a cartridge includes a supply wick, a compensating body and a writing tip with a ball, wherein the ball is fastened and rotatably mounted in a tube, and wherein the tube has a continuous ink duct. The ink duct of the ballpoint pen is constructed as a free throughbore and does not have any additional core bodies or ink conductors, and the supply wick extends axially completely through the compensating body in the area of the compensating chambers formed in the compensating body.

12 Claims, 2 Drawing Sheets

BALLPOINT PEN FOR INK

BACKGROUND OF THE INVENTION

1. Field of the Invention

The present invention relates to a ballpoint pen for ink. Particularly, the invention relates to a ballpoint pen in which the ink is freely received in the shaft of the ballpoint pen or is received in a cartridge. The ballpoint pen includes a supply wick, a compensating body and a writing tip with a ball, wherein the ball is fastened and rotatably mounted in a tube, and wherein the tube has a continuous ink duct.

2. Description of the Related Art

The ballpoint pens in question are particularly those which are directly filled with liquid ink, i.e., low viscosity ink. The ink to be used can be manufactured on the basis of water or alcohol and may be freely present in the ballpoint pen. The proposed ballpoint pen can preferably be used as a manual writing utensil or also as a writing or drawing insert in registering devices, plotters, or other automatic or mechanical recording devices or mechanical units.

Such a directly filled ballpoint pen usually is composed of a shaft and/or a cartridge in which the ink is contained and which serves simultaneously as a holder as well as a reservoir, a liquid supply system connected or connectable to the reservoir and possibly a compensating system and a writing tip and possibly a closing cap and further parts.

Ballpoint pens of this type are known in principle. For example, DE-OS 44 34 164 describes and illustrates various writing inserts for ink writing utensils with different writing tips which include a supply system as well as a compensating system. In the ballpoint pen tip shown, for example, in FIG. 1 of DE-OS 44 34 164, the writing ball is mounted in a thin tube. Placed in the wall of the tube is a wick or needle in order to improve the highly capillary ink flow up to the ball.

Particularly when the ballpoint pens are manufactured on an industrial scale, it has been found that tips of this type are relatively expensive. In addition, the ink systems have the tendency to easily dry or clog in the tip area.

German patents 23 07 620 and 806 413 disclose additional ballpoint pens of the above-described type which include capillary pin-shaped inserts in the supply area, so that a good flow of the writing medium is ensured. In German patent 23 07 620, a cartridge is provided as the writing medium reservoir and in German patent 806 413, the ink is directly filled into the shaft.

The disadvantages of these writing utensils are particularly to be seen in the fact that they have no compensating systems, as in the case of German patent 23 07 620, or only very insufficient compensating systems, as is the case in German patent 806 413, and, therefore, have the tendency to leak particularly in the case of pressure variations. In addition, the ink discharge may take place irregularly if the end portions of the intermediate wicks do not sufficiently absorb or discharge the ink.

These known ballpoint pens are also not suitable or only insufficiently suitable for the use of small balls to carry out fine strokes or lines.

SUMMARY OF THE INVENTION

Therefore, it is the primary object of the present invention to provide a directly filled ballpoint pen which is also suitable for relatively small balls, wherein the ballpoint pen can be manufactured in a simple, inexpensive and economical manner, wherein the ballpoint pen can receive a large ink volume and the ink volume can be properly and completely used up, and wherein the ballpoint pen still compensates pressure variations well and writes reliably over long periods of time.

In accordance with the present invention, the ink duct of the ballpoint pen is constructed as a free throughbore and does not have any additional core bodies or ink conductors, and the supply wick extends axially completely through the compensating body in the area of the compensating chamber.

The various features of novelty which characterize the invention are pointed out with particularity in the claims annexed to and forming a part of the disclosure. For a better understanding of the invention, its operating advantages, specific objects attained by its use, reference should be had to the following descriptive matter in which there are described preferred embodiments of the invention.

DESCRIPTION OF THE PREFERRED EMBODIMENTS

Figure 1:
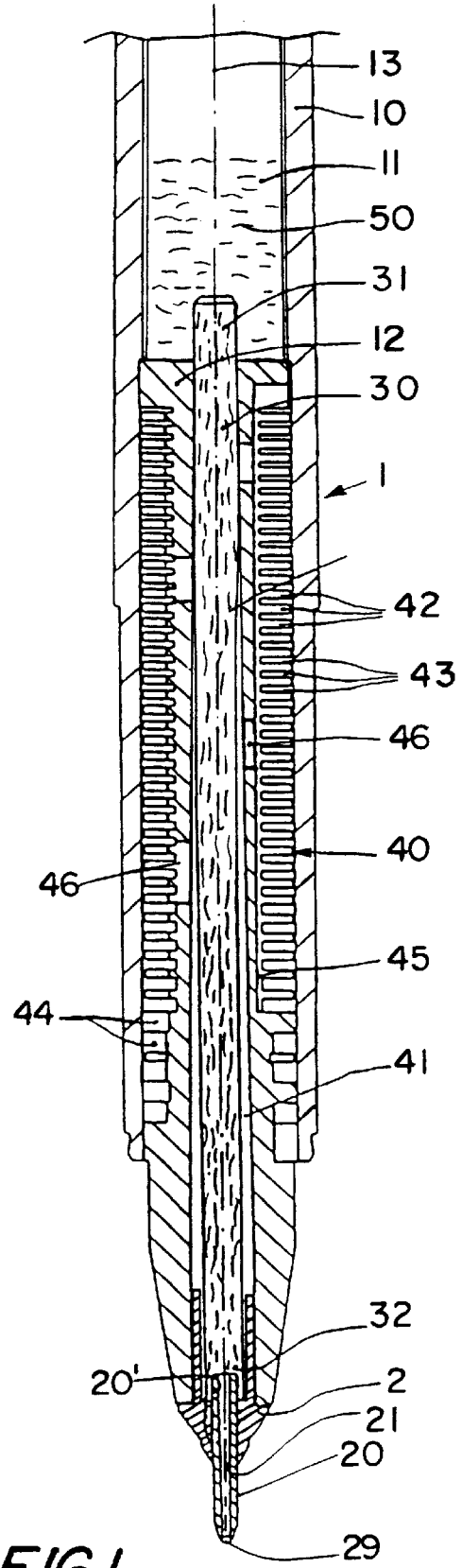
FIG. 1 is a partial sectional view of a ballpoint pen according to the present invention.
Figure 2:
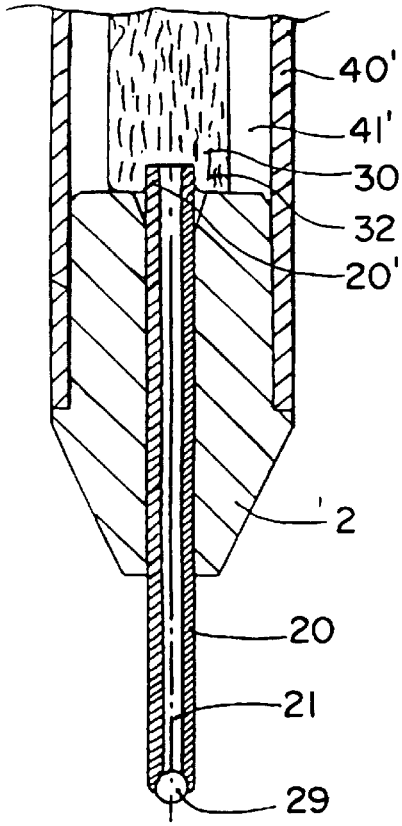
FIG. 2 is a partial sectional view, on a larger scale, showing the tip of another embodiment of the ballpoint pen according to the present invention.
Figure 3:
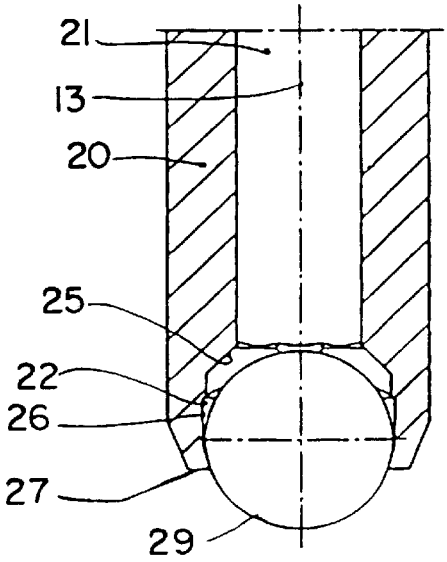
FIG. 3 is a partial sectional view, on an even larger scale, of the tip area of the ballpoint pen according to the present invention.
Figure 4:
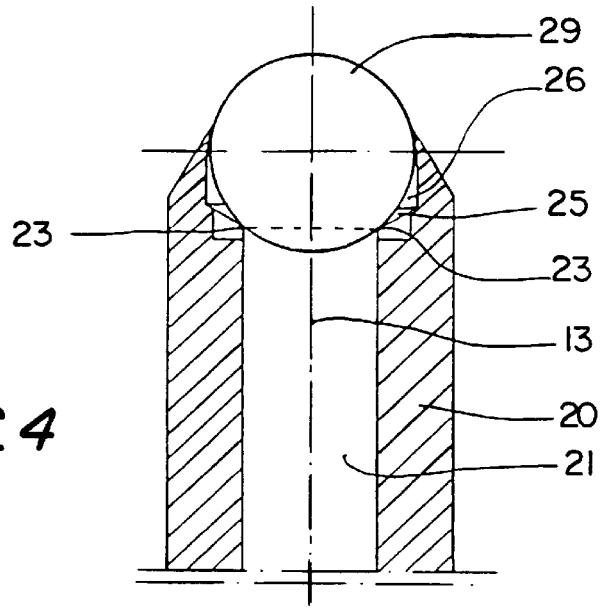
FIG. 4 is a partial sectional view of another embodiment of the tip portion of the ballpoint pen.
Figure 5:
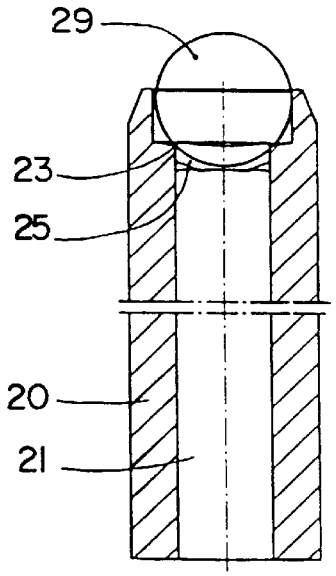
FIG. 5 is a sectional view corresponding to FIG. 3, turned by 90 degrees.
Figure 7:
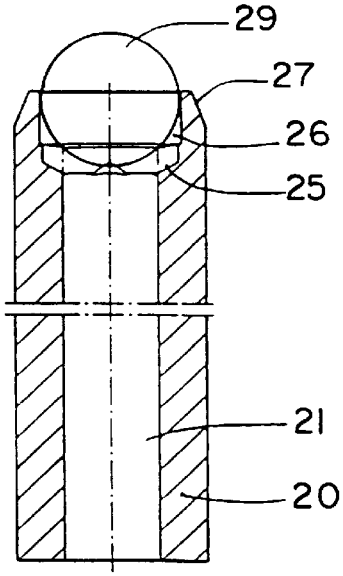
FIG. 7 is a sectional view showing the embodiment of FIG. 5, turned by 90 degrees.
Figure 6:
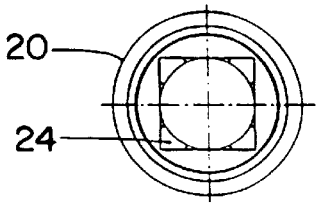
FIG. 6 is a top view of the tip of the embodiment of FIG. 5, shown without the ball.
Figure 8:
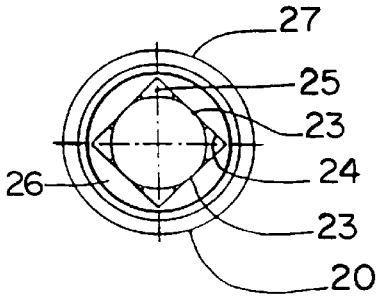
FIG. 8 is a top view of the tip of the embodiment of FIG. 7, shown without the ball.

A ballpoint pen 1 shown in FIGS. 1–8 contains ink 50 received either freely in the shaft 10 or in a cartridge; the ballpoint pen 1 includes a supply wick 30, a large compensating body 40 having a high absorbing capacity, and a writing tip 2 with a ball 29, wherein the ball 29 is mounted and rotatably supported in the tube end 27 of a tube 20 and the tube 20 has a continuous ink duct 21. In accordance with the present invention, the ink duct 21 is a free throughbore and does not contain any additional core bodies or other ink conductors. In addition, the supply wick 30 extends axially completely through the compensating body 40 in the area of the compensating system or the compensating chambers 43, i.e., in the area of the lamellae, so that the wick 30 has at both ends 31, 32 free contact points for the ink 50, on the one hand, and for the tube 20 at the other end 32.

The rearward ink end 31 of the wick 30 protrudes above the closure 12 of the ink chamber 11 and ends within the ink chamber 11. A protruding distance of 2–15 mm has usually been found sufficient and advantageous.

The supply wick 30 should be open at the end face thereof and it should be permeable to ink and absorptive at the circumference thereof. It is also particularly advantageous if the tube 20 is pressed with its tube end 20' into the front connecting end 32 of the supply wick 30. Consequently, an ink drop is always automatically formed within the ink duct 21.

In order to get the ballpoint pen ready for the first operation, the ballpoint pen has to be "centrifuged" in the factory or shaken mechanically, as this is also absolutely required in conventional ballpoint pens for pastes, so that especially the ink duct 21 is for the first time completely filled with ink. The further flow of ink, particularly also during writing, then takes place automatically, particularly due to capillary forces.

The supply wick 30 may advantageously be a fibrous polyester wick or may be composed of foamed or sintered polyethylene. If the capillary volume of the wick is between 40–70% by volume, preferably about 60% by volume, a good ink flow is obtained. Particularly good results are achieved with these types of wicks. The continuous ink duct 21 of the tube 20 should or may have a diameter of 0.2 to 0.6 mm, preferably 0.4 mm. The dimension of the tube 20 depends on the size of the ball to be used, on the one hand, and also on the fluidity or viscosity of the ink to be used, on the other hand.

It has also been found to be advantageous if the tube 20 is composed of a stain-resistant and acid-resistant (stainless) special, high-grade steel with 15 to 20% chromium and 5 to 15% nickel. Since especially aqueous inks and also some coloring agents lead to the formation of rust on metal parts, high-grade steels with relatively high chromium and nickel contents are particularly suitable.

When used in automatic lathes and other mechanical processing machines, other special alloying components may be added, such as, sulphur or selenium, which improve or facilitate the chip-removing processing and increase the service lives of the tools. The ball 29 should preferably be of hard metal and have a diameter of 0.4 to 0.8 mm, preferably 0.6 mm.

The compensating system is preferably provided with a compensating body 40 (FIG. 1), 40' (FIG. 2) which has an axially continuous bore 41 (FIG. 1), 41' (FIG. 2) and a plurality of fine lamellae 42 which form capillary compensating chambers 43 therebetween, wherein channels 46 provide communication between the wick 30 in the bore 41 and chambers 43. In addition, the compensating body 40 has an axially extending non-capillary air duct 44 and at least one axial capillary duct 45.

For achieving good and easy running properties, the support of the ball 29 in the ball bed 22 of the tube 20 should take place as much as possible in individual points.

For this purpose, the ball bed 22 of the tube 20 preferably has four support edges 23 on which the ball 29 is supported in point-like locations.

If the ball bed 22 of the tube 20 has a square embossment 24, a good capillary system over a surface area underneath the ball in the area of the ball bed 22 is achieved. In this case, it is not necessary to press the ball into a dome-shaped bed. The square embossment 24 advantageously should have an axial depth of 0.02 to 0.10 mm and should have an opening width which corresponds essentially to the diameter of the bore 21, and a corner dimension which corresponds essentially to the diameter of the ball bore 26.

The ball bed 22 of the tube 20 should have inclined capillary surfaces 25 with an inclination of 20°–50°, preferably 30°, relative to a perpendicular line to the pen axis 13.

The invention is not limited by the embodiments described above which are presented as examples only but can be modified in various ways within the scope of protection defined by the appended patent claims.

We claim:

1. A ballpoint pen comprising a shaft, a compensating body with compensating chambers and a supply wick mounted within the shaft, wherein ink is freely received in the shaft or ink is received in a cartridge in the shaft, and a writing tip at a front end of the ballpoint pen, a tube mounted at the writing tip, and a ball being mounted and rotatably supported in the tube, wherein the tube has a ball bed and the ball is configured to rest on the ball bed in individual points, wherein the ball bed is a square embossment having four support edges, wherein each support edge forms one of the individual points for supporting the ball, wherein the tube has a continuous ink duct, wherein the ink duct is configured as a free throughbore without an additional core body or ink conductor, wherein the supply wick extends axially completely through the compensating body in an area of the compensating chambers, wherein the compensating body has channels configured to provide communication between the wick and the compensating chambers, wherein an ink chamber is defined in the shaft and a closing means for the ink chamber is mounted in the shaft, wherein an end of the wick protrudes beyond the closing means of the ink chamber and ends within the ink chamber for absorbing ink, and wherein the tube is pressed with an end thereof into a front connecting end of the supply wick.

2. The ballpoint pen according to claim 1, wherein the supply wick is a polyester wick and has a capillary volume of 40%–70%.

3. The ballpoint pen according to claim 2, wherein the capillary volume is 60%.

4. The ballpoint pen according to claim 1, wherein the continuous ink duct of the tube has a diameter of 0.2 mm to 0.6 mm.

5. The ballpoint pen according to claim 4, wherein the diameter of the ink duct is 0.4 mm.

6. The ballpoint pen according to claim 1, wherein the tube is stainless, high-grade steel with 15%–20% chromium and 5%–15% nickel.

7. The ballpoint pen according to claim 1, wherein the ball is of hard metal and has diameter of 0.4 mm to 0.8 mm.

8. The ballpoint pen according to claim 7, wherein the diameter of the ball is 0.6 mm.

9. The ballpoint pen according to claim 1, wherein the compensating body has an axially continuous bore, a plurality of fine lamellae forming the compensating chambers therebetween, an axially extending air duct and at least one axial capillary duct.

10. The ballpoint pen according to claim 1, wherein the square embossment has an opening width which corresponds essentially to an internal diameter of the ink duct.

11. The ballpoint pen according to claim 1, wherein the ball bed of the tube forms a ball bore having a diameter, and wherein the square embossment has a corner dimension which corresponds essentially to the diameter of the bore wall.

12. The ballpoint pen according to claim 1, wherein the ball bed of the tube has inclined capillary surfaces, the ballpoint pen having an axis, wherein the capillary surfaces have an inclination of 20° to 50° relative to the pen axis.

* * * * *